US007320360B2

(12) United States Patent
Leitch et al.

(10) Patent No.: US 7,320,360 B2
(45) Date of Patent: Jan. 22, 2008

(54) ONE-SHOT BRAZED AFTERCOOLER WITH HOLLOW BEAM REINFORCED MOUNTING FEATURE

(75) Inventors: Frank Joseph Leitch, North Tonawanda, NY (US); Brian J. Coyle, Orchard Park, NY (US); Robert Charles Gmerek, Burt, NY (US); Robert C Thompson, Lockport, NY (US); Michael J Pachucinski, Elma, NY (US)

(73) Assignee: Delphi Technologies, Inc., Troy, MI (US)

( * ) Notice: Subject to any disclaimer, the term of this patent is extended or adjusted under 35 U.S.C. 154(b) by 600 days.

(21) Appl. No.: 10/988,371

(22) Filed: Nov. 12, 2004

(65) Prior Publication Data

US 2006/0102330 A1 May 18, 2006

(51) Int. Cl.
*F28D 1/00* (2006.01)
*F28F 9/02* (2006.01)

(52) U.S. Cl. ..... 165/149; 165/173

(58) Field of Classification Search ..... 165/67, 165/149, 151, 153, 173; 248/DIG. 903
See application file for complete search history.

(56) References Cited

U.S. PATENT DOCUMENTS 1,799,691 A * 4/1931 Karmazin ..... 165/149
4,441,547 A * 4/1984 Argyle et al. ..... 165/67
5,086,835 A * 2/1992 Shinmura ..... 165/144
5,127,466 A * 7/1992 Ando ..... 165/67
5,183,103 A * 2/1993 Tokutake ..... 165/67
5,197,538 A * 3/1993 Nagasaka et al. ..... 165/144
5,363,910 A * 11/1994 Baba et al. ..... 165/153
5,373,896 A * 12/1994 Osborn ..... 165/173
5,443,116 A * 8/1995 Hayashi et al. ..... 165/149
5,458,190 A * 10/1995 Sasaki et al. ..... 165/110
5,509,199 A * 4/1996 Beamer et al. ..... 29/890.07
5,509,276 A * 4/1996 O'Brien ..... 62/298
7,040,380 B1 * 5/2006 O'Brien ..... 165/67

FOREIGN PATENT DOCUMENTS

JP 10-153397 A * 6/1998

* cited by examiner

*Primary Examiner*—Mohammad M. Ali
(74) *Attorney, Agent, or Firm*—Patrick M. Griffin

(57) ABSTRACT

A heat exchanger assembly includes hollow reinforcing members that define openings for receiving supports therein. An end cap is disposed in each open end of cylindrical header tanks and each of the header tanks includes a tubeless length (X) extending inwardly a predetermined distance from each end cap. An inlet and an outlet are disposed in a tubeless length (X). The ends of the reinforcing members extending over the tubeless lengths (X) of the header tanks which include a slot outside each end cap with a tab extending from each end of reinforcing members and into the adjacent slot. All of the components are brazed together in one operation.

23 Claims, 2 Drawing Sheets

ONE-SHOT BRAZED AFTERCOOLER WITH HOLLOW BEAM REINFORCED MOUNTING FEATURE

BACKGROUND OF THE INVENTION

1. Field of the Invention

A heat exchanger assembly.

2. Description of the Prior Art

The heat exchanger of the type to which the subject invention pertains includes a plurality of tubes and a plurality of fins disposed between the tubes to define a core extending between a pair of spaced and parallel header tanks and a pair of reinforcing members extending between the header tanks.

The fabrication of such heat exchangers frequently include sequential steps of brazing the various components together followed by welding brackets to the reinforcing members. The reinforcing members are frequently welded to the header tanks in addition to the brazing to assure the requisite structural connection.

In addition, brackets are either welded to the reinforcing members or clamped/snapped into or around or over the reinforcing members to engage the core. Consequently, especially configured brackets must be inventoried, handled in a fabrication process that includes numerous and independent brazing and welding steps.

SUMMARY OF THE INVENTION AND ADVANTAGES

The invention provides a method of fabricating a heat exchanger assembly by disposing a pair of reinforcing members each having a hollow and closed cross section extending between the header tanks.

Accordingly, the assembly may be mounted without welding an additional bracket to the reinforcing members. In addition, the entire assembly may be brazed together in one brazing operation.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
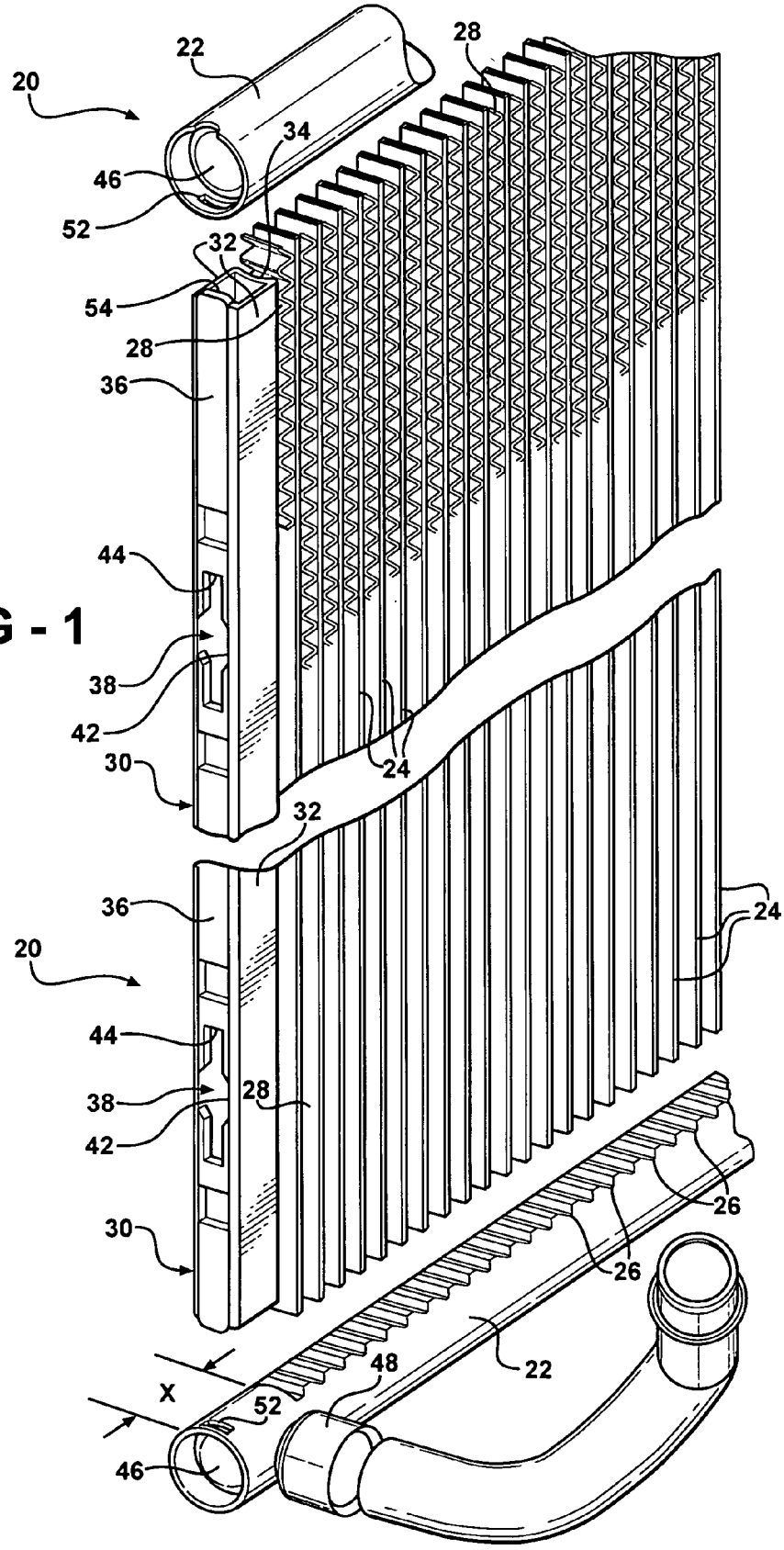
FIG. 1 is fragmentary perspective view of a heat exchanger constructed in accordance with the subject invention.
Figure 2:
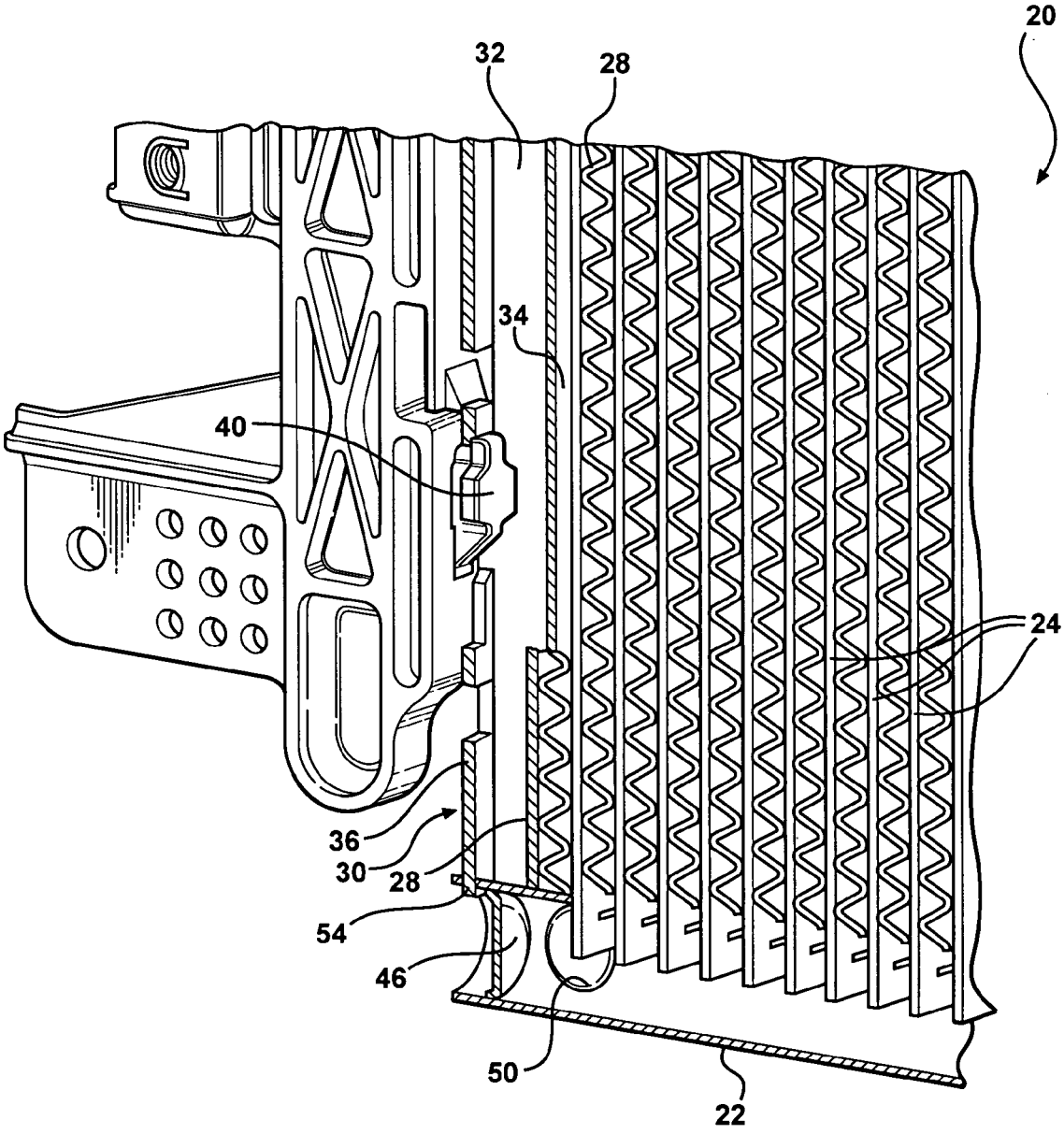
FIG. 2 is an exploded perspective view partially cut away and in cross section.

A heat exchanger assembly is shown generally at 20 and comprises a pair of spaced and parallel header tanks 22 each extending between opposite open ends. Each of the header tanks 22 has a round or circular cross section presenting a convex exterior. A plurality of flat tubes 24 extend between the header tanks 22 for conveying fluid there between. The header tanks 22 have slits 26 extending tangentially of the cylindrical header tanks 22 for receiving the ends of the flat tubes 24. A plurality of fins 28 are disposed between the tubes 24 for transferring heat, although the fins 28 are not shown between all of the tubes 24 for simplicity and clarity, i.e., less drawing clutter. The plurality of tubes 24 and the plurality of fins 28 disposed between the tubes 24 define a core extending between the header tanks 22. A pair of reinforcing members 30, each generally indicated at, extend between the ends of the header tanks 22.

The assembly 20 is distinguished by each of the reinforcing members 30 having a hollow and closed shape or cross section, e.g. rectangular with spaced face walls 32 extending along an axis perpendicular to the header tanks 22 and an inner wall 34 facing the fins 28 and an outer wall 36. The fins 28 between the last tube 24 and the inner wall 34 are partially cut away for clarity but the bond of the reinforcement member 30 to the fin 28 over the entire length enhances mounting structural integrity. The outer wall 36 of each reinforcing member 30 has a pair of spaced openings 38, each generally indicated at, for receiving a pair of supports 40 therein. The support 40 includes a head and a smaller shank and each of the openings 38 includes a large receiving portion 42 and a smaller retaining portion 44 for receiving the head of a support 40 through the receiving portion 42 and retaining the head behind the retaining portion 44 as shank of the support 40 extends through the retaining portion 44. The support 40 extends from a bracket that is used to mount the assembly 20 with other components of an engine cooling module. For example, the assembly 20 may be an aftercooler sandwiched with the radiator and fan. The reinforcement member 30 allows ancillary components to interface with heat exchanger without fasteners on multiple locations.

An end cap 46 disposed in each open end of the header tanks 22 and each of the header tanks 22 includes a tubeless length X extending inwardly a predetermined distance from each end cap 46. An inlet 48 is disposed in the tubeless length X of one of the header tanks 22 and an outlet 50 is disposed in the tubeless length X of the other of the header tanks 22. The inlet 48 and the outlet 50 extend perpendicularly to the header tanks 22 and to the core.

The reinforcing members 30 have ends with the hollow and closed cross section of the reinforcing members 30 at the ends extending over the tubeless lengths X. The header tanks 22 each include a slot 52 disposed outside each end cap 46 and each reinforcing member 30 includes a tab 54 extending from each end of the outer wall 36 of the reinforcing members 30 and into the adjacent slot 52. In addition, the ends of the inner walls 34 of the reinforcing members 30 include a concave segment engaging the convex exterior of the cylindrical header tanks 22.

The reinforcing members 30 and the inlet 48 and the outlet 50 are brazed to the header tanks 22. An all aluminum assembly 20 allows the entire assembly 20 to be brazed together in one operation. In other words, the manifolds or tanks 22 will have lanced or pierced slits 26 to accept the aluminum tubes 24 and the reinforcing members 30 engage the exterior of the tanks 22 as all of these components of the entire assembly 20 are brazed together in one operation.

Accordingly, a method is provided for fabricating a heat exchanger including a plurality of tubes 24 and a plurality of fins 28 disposed between the tubes 24 to define a core extending between a pair of spaced and parallel header tanks 22 by disposing a pair of reinforcing members 30 each having a hollow and closed cross section extending between the header tanks 22. The method includes disposing an end cap 46 in each end of the header tanks 22, disposing tubes 24 in each of the header tanks 22 up to a predetermined distance from each end to define a tubeless length X extending inwardly from each end cap 46, disposing an inlet 48 in the tubeless length X of one of the header tanks 22 and disposing an outlet 50 in the tubeless length X of the other of the header tanks 22. Also included is the step of disposing the ends of the reinforcing members 30 with the hollow and closed cross section extending over the tubeless lengths X.

The method is further defined by disposing a slot 52 outside each end cap 46 in each header tank 22 and disposing a tab 54 extending from each end of each reinforcing member 30 into the adjacent slot 52. The assembly 20 is fabricated with each of the header tanks 22 having a round cross section and the ends of the reinforcing members 30 having a concave segment engaging the convex exterior of the header tanks 22.

As alluded to above, the method allows the brazing of the entire assembly 20 together in one brazing operation with brazing between the header tanks 22 and the reinforcing members 30 and between the reinforcing members 30 and the core. Afterward, the assembly 20 may be mounted by inserting a support 40 into the opening 38 in each reinforcing member 30.

Obviously, many modifications and variations of the present invention are possible in light of the above teachings. The invention may be practiced otherwise than as specifically described within the scope of the appended claims. In addition, the reference numerals in the claims are merely for convenience and are not to be read in any way as limiting.

What is claimed is:

1. A heat exchanger assembly comprising;

a pair of spaced and parallel header tanks each extending between opposite ends, a plurality of tubes extending between said header tanks for conveying fluid there between, a plurality of fins disposed between said tubes for transferring heat, a pair of reinforcing members extending between said ends of said header tanks, and characterized by each of said reinforcing members having a hollow and closed cross section.

2. An assembly as set forth in claim 1 wherein each of said reinforcing members defines an opening for receiving a support therein.

3. An assembly as set forth in claim 2 wherein each of said openings includes a large receiving portion and a smaller retaining portion for receiving the head of a support through said receiving portion and retaining the head behind the retaining portion as shank of the support extends through the retaining portion.

4. An assembly as set forth in claim 3 wherein said hollow and closed cross section is rectangular.

5. An assembly as set forth in claim 1 including an end cap disposed in each end of said header tanks and each of said header tanks including a tubeless length (X) extending inwardly from each end cap, an inlet disposed in said tubeless length (X) of one of said header tanks and an outlet disposed in said tubeless length (X) of the other of said header tanks.

6. An assembly as set forth in claim 5 wherein said reinforcing members have ends with said hollow and closed cross section of said reinforcing members at said ends extending over said tubeless lengths (X).

7. An assembly as set forth in claim 6 wherein said header tanks each include a slot disposed outside each end cap and each reinforcing member includes a tab extending from each end and into the adjacent slot.

8. An assembly as set forth in claim 7 wherein each of said header tanks has a round cross section presenting a convex exterior and each of said ends of said reinforcing members includes a concave segment engaging the convex exterior of said header tanks.

9. An assembly as set forth in claim 8 wherein said hollow and closed cross section is rectangular with spaced face walls extending perpendicular to said header tanks and an inner wall facing said tubes and an outer wall having an opening for receiving a support therein.

10. An assembly as set forth in claim 9 wherein said tab extends from said outer wall and said inner wall presents said concave segment at each end of said reinforcing members.

11. An assembly as set forth in claim 10 wherein said inlet and outlet extend perpendicularly to said header tanks.

12. An assembly as set forth in claim 11 wherein said reinforcing members are brazed to said header tanks.

13. An assembly as set forth in claim 12 wherein said inlet and said outlet are brazed to said header tanks.

14. An assembly as set forth in claim 13 wherein each of said openings includes a large receiving portion and a smaller retaining portion for receiving the head of a support through said receiving portion and retaining the behind the retaining portion as shank of the support extends through the retaining portion.

15. A method of fabricating a heat exchanger including a plurality of tubes and a plurality of fins disposed between the tubes to define a core extending between a pair of spaced and parallel header tanks, said method characterized by disposing a pair of reinforcing members each having a hollow and closed cross section extending between the header tanks.

16. A method as set forth in claim 15 including disposing an end cap in each end of the header tanks, disposing tubes in each of the header tanks up to a predetermined distance from each end to define a tubeless length (X) extending inwardly from each end cap, disposing an inlet in the tubeless length (X) of one of the header tanks and disposing an outlet in the tubeless length (X) of the other of the header tanks.

17. A method as set forth in claim 16 including disposing the ends of the reinforcing members with the hollow and closed cross section extending over the tubeless lengths (X).

18. A method as set forth in claim 17 including disposing a slot outside each end cap in each header tank and disposing a tab extending from each end of each reinforcing member into the adjacent slot.

19. A method as set forth in claim 18 including fabricating the assembly with each of the header tanks having a round cross section and the ends of the reinforcing members having a concave segment engaging the convex exterior of the header tanks.

20. A method as set forth in claim 19 including fabricating the assembly with each hollow and closed cross section being rectangular with spaced face walls extending perpendicular to the header tanks and an inner wall facing the tubes and an outer wall having an opening for receiving a support therein.

21. A method as set forth in claim 20 including fabricating the assembly with the tab extending from the outer wall and the inner wall presenting the concave segment at each end of the reinforcing members.

22. A method as set forth in claim 17 including brazing the assembly together with brazing between the header tanks and the reinforcing members and between the reinforcing members and the core.

23. A method as set forth in claim 17 including fabricating the assembly with each reinforcing member defining an opening for receiving a support therein.

* * * * *